US006338166B1

(12) United States Patent
Hereford

(10) Patent No.: US 6,338,166 B1
(45) Date of Patent: Jan. 15, 2002

(54) FEMALE URINARY RECEPTACLE

(76) Inventor: Erma Hereford, 392 E. Stevens Rd., Palm Springs, CA (US) 92262

( * ) Notice: Subject to any disclaimer, the term of this patent is extended or adjusted under 35 U.S.C. 154(b) by 0 days.

(21) Appl. No.: 09/335,850

(22) Filed: Jun. 23, 1998

Related U.S. Application Data

(63) Continuation-in-part of application No. 08/823,334, filed on Mar. 24, 1997, now abandoned.

(51) Int. Cl.[7] ..... A47K 11/12
(52) U.S. Cl. ..... 4/144.3; 4/144.1
(58) Field of Search ..... 4/144.1, 144.2, 4/144.3, 144.4; 604/327, 329, 355

(56) References Cited

U.S. PATENT DOCUMENTS 3,335,714 A * 8/1967 Giesy ..... 4/144.3 X
3,432,863 A * 3/1969 Schwartz ..... 4/144.3 X
3,995,329 A * 12/1976 Williams ..... 4/144.4

FOREIGN PATENT DOCUMENTS

GB 728916 * 4/1955 ..... 4/144.3

* cited by examiner

*Primary Examiner*—Robert M. Fetsuga

(57) ABSTRACT

A urinary receptacle for use with both men and women. The receptacle includes a container. A neck portion extends through a top wall of the container. A female adaptor portion is adapted for removable coupling with the neck portion. A handle portion is formed integrally with the handle portion.

1 Claim, 3 Drawing Sheets

FEMALE URINARY RECEPTACLE

RELATED APPLICATION

This application is a continuation-in-part of an application filed Mar. 24, 1997 under Ser. No. 08/823,334 abandoned.

BACKGROUND OF THE INVENTION

1. Field of the Invention

This invention relates to a urine collecting receptacle for a female which can be used independently without the assistance of a caretaker or assistant and can be used in any position but most specifically for the bedridden or weakened female in the supine position similar to the familiar urine receptacle available for males. The present invention is equipped with a saddle-like female adaptor portion that can be removed at a screw-off neck portion and can be used as a male urinal as well as a convenient and sanitary way to empty and clean the container.

2. Description of the Prior Art

Due to the anatomy of a male, they can conveniently insert their penis into the neck of a urinal with comfort, dignity, privacy, cleanliness, and convenience. By comparison, because of two factors, women, having those same needs of comfort, dignity, privacy, cleanliness, and convenience, have not had that option. First, a female's urethra is located more internally, being concealed beneath the labia majora and the labia minora. In addition, there is adipose tissue surrounding the perineum, internal thighs and buttocks. Secondly, upon urination, liquid will flow downward with the flow of gravity. Since the urethra is located midway up in the female genitalia, urine will exit outwardly in a seemingly non-specific direction from a lateral position immediately crossing the rectal area, through the folds of the buttocks and out onto whatever surface the female is lying or sitting on.

In order for a receptacle to be capable of an adaptive fit, it would need to allow for the lateral position of the urethra, the downward flow of urine, and allow for the folds and concealing tissue in the perineal area. It would need to have a saddle-shaped adaptive fit in a lateral front-to-back contouring configuration instead of an anterior-posterior apparatus. It would need to provide a water-tight seal, and allow for the above stated specifications.

In the hospital seeing the need for independent, comfortable, safe, and convenient urinating is equal between men and women regardless of their anatomical differences.

In congestive heart failure and other conditions, strong diuretics are administered requiring frequent and large volume voiding. Some diabetic and neurological conditions result in frequent urination. Men presently have urinals that can be used then placed on the bedside table for caretakers to empty when they are able. Women, on the other hand, must wait for the caretaker's assistance. Sometimes, two people are enquired to assist the females to and from the bathroom or bedside commode. This is complicated when the woman is elderly, confused or obese. Since healthcare workers must prioritize their decisions based on emergencies and critical patients, female patients without the convenience of the use of a urinal, may have to wait sometimes long periods of time for assistance.

If a female patent is too ill or weak to get out of bed, they must use a bedpan. This also can require two assistants to et her on and off the bedpan. This can be extremely uncomfortable, undignified, and unsanitary. Especially if the female is obese, the bedpan is easily spilled into the bed or onto the persons perineal area making hygiene difficult and can predispose the patient to infections and skin breakdown which can complicate or be complicated by other conditions.

Unfortunately, women may be at an increased risk of extending a heart attack precipitated by fatigue, stress and exertion performing these toileting tasks.

Women experiencing fractured hips are unable to move or bend their legs or hips and are required to lie supine for long periods of time. Physicians have found it necessary to insert indwelling catheters due to patient's immobility. If there were a receptacle that would allow leakproof, sanitary urinating while in a supine position, it would eliminate the need for a catheter with its potential introduction of infection, discomfort and increased risk of complications.

Many women must be admitted to nursing homes after hospitalizations because they simply need assistance with urinating. If there were a urine receptacle available that could be used without spillage, that would provide privacy, dignity, and cleanliness, many women could be discharged to their homes to care for themselves independently.

Emergency rooms, ambulances, home care and nursing homes have a need to provide convenient, water-tight urinary containers to women as they presently do for men since the need is the same.

Therefore, it can be appreciated that there exists a continuing need for new and improved urine collecting receptacle for a female which can be used independently without the assistance of a caretaker or assistant and can be used in any position but most specifically for the bedridden or weakened female in the supine position similar to the familiar urine receptacle available for males. In this regard, the present invention substantially fulfills this need.

Examples of prior art urinals that fail to meet these needs include:

U.S. Pat. No. 4,050,103 to Nakao discloses a urinating receiver. In such device, fit to the female genitalia is up against the symphysis pubis area and secured into position with a handle but the posterior area is not sealed by having a concave protrusion in between the buttocks and up against the septal area so as urine is emitted into the container, it would naturally go with gravity downward and into the lower perineal area, between the buttocks and onto the bed linen. Since this invention appears to be for a supine bedridden patient, the patient would have to urinate in a lateral direction which would not happen because fluid will always go downward. The present device is a bulky and unnecessary apparatus for collecting urine as once it is collected it would still need to be emptied and there is no purpose for it to be in two parts as the section needing to be held up against the perineum to collect urine would only be used for urination and then removed. There would be no point to leave it in place and consequently no reason to have a continual collection reservoir. The present device would be expensive to provide for every patient and since it would be prohibitive, women would be denied having a needed apparatus as simple as a urinal that all men now have available.

U.S. Pat. No. 5,387,205 to Cummins discloses a self-contained urine collecting device for use by females. The present device must be placed inside the labia majora for proper placement. This is invasive in fact as it must come in contact with the body internally. Correct placement would be vital for it to be water-tight. Injury could occur if the patient is ill, confused, unable to reach her own perineum such as in morbid obesity and assistance would be needed for placement which could cause further injury. Placing the present device inside the labia is unsanitary as body fluids, urine, and mucous would accumulate on the surface touching the body and unless it is cleaned thoroughly with disinfectant it could introduce germs with future use. The angle of the urinal once it is placed is such that gravity would not allow urine to flow downward. Urine would consequently spill down into the perineum and between the folds of the buttocks causing hygiene problems and the potential for infection and skin breakdown due to bacteria and moisture. It would be difficult to remove the urinal from between the legs without spilling it because the angle is such that the person would have to stand to remove without spilling. The angle of the neck extending to the body of the receptacle would require the user to urinate laterally in order to fill the container and in order to remove it would be inadvertently spilled especially if it were more than ½ full. Fluid must flow downward with gravity. Women have internal urethras with surrounding soft tissue. This invention requires an internal placement inside the labia which is unsanitary and could injure the soft tissue.

U.S. Pat. No. 3,711,871 to Sherin discloses a female urinal apparatus. This apparatus is simply a funnel for collection of urine. It is meant to be fitted up against the perineum in a standing position only. There is no feature of contour fitting that could adapt to a water-seal function with a person in a supine position.

Further prior art examples include:

U.S. Pat. No. 5,406,651 to Nogay discloses a female urinal apparatus.

U.S. Pat. No. 4,665,571 to Muccione discloses a urinal.

U.S. Pat. No. 4,769,858 to Gamm et al. discloses a urinal bottle.

U.S. Pat. No. 5,450,632 to Esswein et al. discloses a standing urinal.

U.S. Pat. No. 4,696,067 to Woodward discloses a women's urinal for use in erect position.

U.S. Pat. No. Des. 286,569 to Nakao et al. discloses the ornamental design for a urinal for female patient.

While these devices fulfill their respective, particular objective and requirements, the aforementioned patents do not describe a urinary receptacle for providing a urine collecting receptacle for a female which can be used independently without the assistance of a caretaker or assistant and can be used in any position but most specifically for the bedridden or weakened female in the supine position similar to the familiar urine receptacle available for males.

SUMMARY OF THE INVENTION

In the view of the foregoing disadvantages inherent in the known types of urinals now present in the prior art, the present invention provides an improved urinary receptacle. As such, the general purpose of the present invention, which will be described subsequently in greater detail, is to provide a new and improved urinary receptacle and method which has all the advantages of the prior art and none of the disadvantages.

To attain this, the present invention essentially comprises a container having a generally rectangular configuration. The container has a top wall, a bottom wall, a pair of opposed long side walls, and a pair of opposed short side walls together forming a liquid holding interior. The device includes a neck portion comprising an aperture directed through the top wall of the container inwardly of one of the pair opposed short walls. The neck portion has a generally cylindrical configuration. The neck portion extends angularly upward from the container. The neck portion has an open upper end. The open upper end has an annular protrusion disposed interiorly therearound. The device includes a female adaptor portion having a cylindrical lower portion and an upper portion. The cylindrical lower portion has an annular recess exteriorly thereof and a stop mechanism disposed above the annular recess. The cylindrical lower portion is dimensioned for positioning within the open upper end of the neck portion whereby the annular protrusion snapidly engages the annular recess. The stop mechanism prevents the female adaptor portion from sliding entirely within the neck portion. The upper portion includes a periphery having a generally linear anterior extent and a posterior extent including a pair of tapering side portions. Preferably, the tapering side portions of the posterior extent of the periphery is lined with a cushioned area. As shown in FIG. 6, such cushioning is afforded by way of a hollow pad formed of a soft rubber which is integrally coupled to the side portions of the posterior extent of the periphery. The pad has a closed loop cross-section along a length thereof which is defined by a horizontally oriented top portion and a pair of converging tapered side portions. With reference now to FIGS. 4, 5 & 7, the upper portion preferably includes an elongated posterior protrusion integrally formed between the ends of the pad and situated along an axis which remains in parallel with a longitudinal axis of the container. Further, the elongated posterior protrusion has a length which is greater than a width of the pad. The upper portion of the female adapter further includes an anterior dam which extends along an entire length of the linear anterior extent of the periphery of the upper portion. The anterior dam preferably has a height equal to that of the elongated protrusion. A handle portion is formed integrally with the neck portion. The handle portion extends from the neck portion in an essentially parallel relationship with the top wall of the container. A lower surface of the handle portion has grips formed therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved urinary receptacle which has all the advantages of the prior art urinals and none of the disadvantages.

It is another object of the present invention to provide a new and improved urinary receptacle which may be easily and efficiently manufactured and marketed.

It is a further object of the present invention to provide a new and improved urinary receptacle which is of durable and reliable construction.

An even further object of the present invention is to provide a new and improved urinary receptacle which is susceptible of a low cost of manufacture with regard to both materials and labor, and which accordingly is then susceptible of low prices of sale to the consuming public, thereby making such a urinary receptacle economically available to the buying public.

It is another object of this invention to address the above-described difficulties by focusing on overcoming the anatomical differences between the male and female urethral configuration based on the assumption that the elimination, comfort, dignity, convenience needs are the same.

Furthermore, it still yet another object of this invention to make the assumption fluids will always flow downward and in order to effectively be collected in a receptacle for a female, certain adaptive water-tight, anatomical features must be addressed.

It is further the purpose of this invention to provide healthcare workers a device for women that offers the same function men have had for years. Also, critically ill women need to urinate without worsening their condition or putting them at a medical risk. This device further offers a means for women to void without having invasive indwelling catheters inserted when it would not ordinarily have to be performed thus exposing them to urethral, bladder or kidney infections. Women already have a natural predisposition to infection of the urethra and bladder due to the close proximity to the vagina and rectal area. When a catheter is introduced with poor visibility for insertion, it further puts women at risk. The best protection is not to introduce any bacteria through an invasive catheter if it can be avoided. A female urinal that functions properly offers that advantage.

Lastly, it is an object of the present invention to provide a new and improved urinary receptacle including a container. A neck portion extends through a top wall of the container. A female adaptor portion is adapted for removable coupling with the neck portion. A handle portion is formed integrally with the handle portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
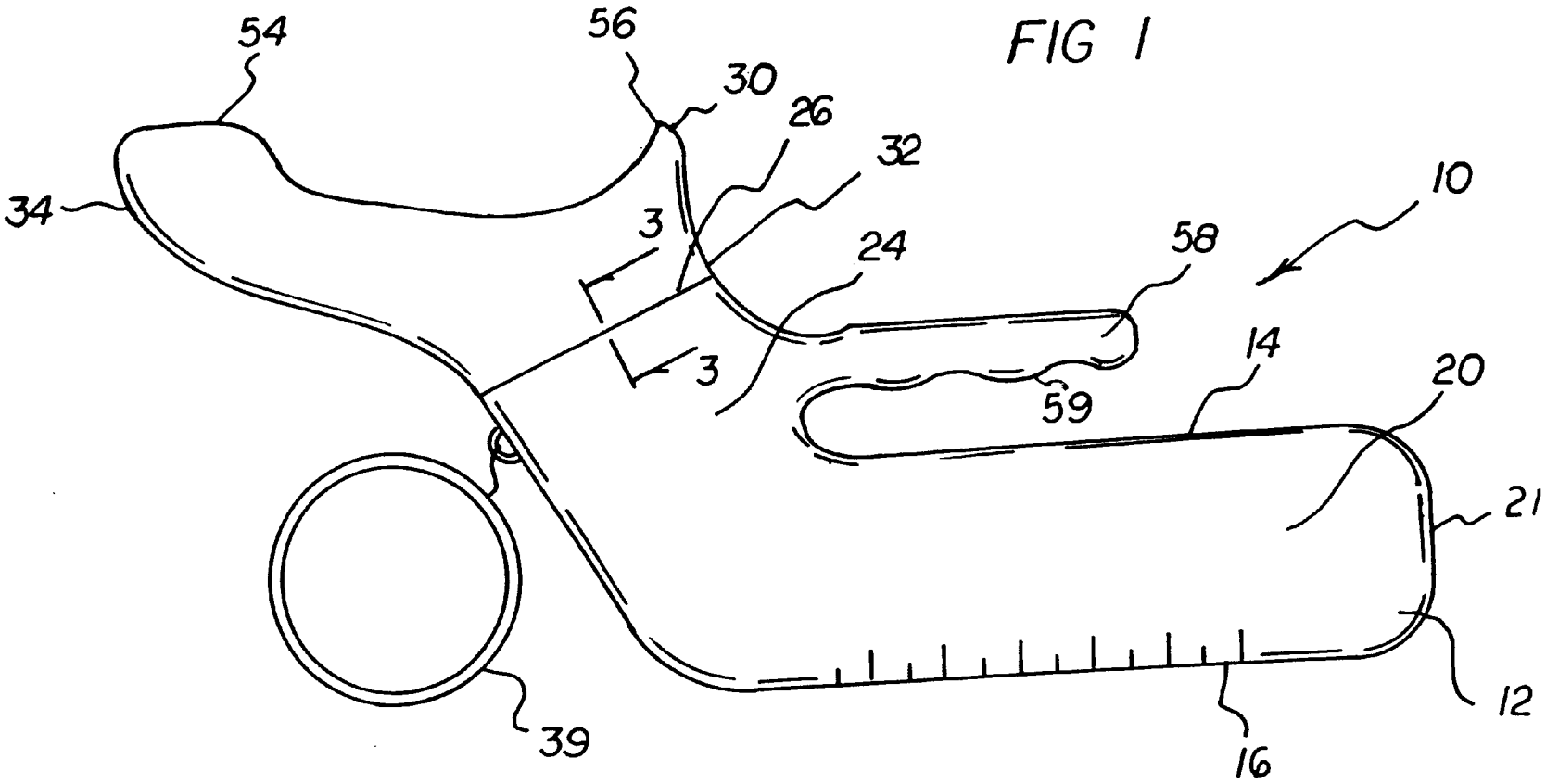
FIG. 1 is a side view of the invention showing the urine receptacle device. It has a detachable female portion, a handle with grips, and a lid.
Figure 2:
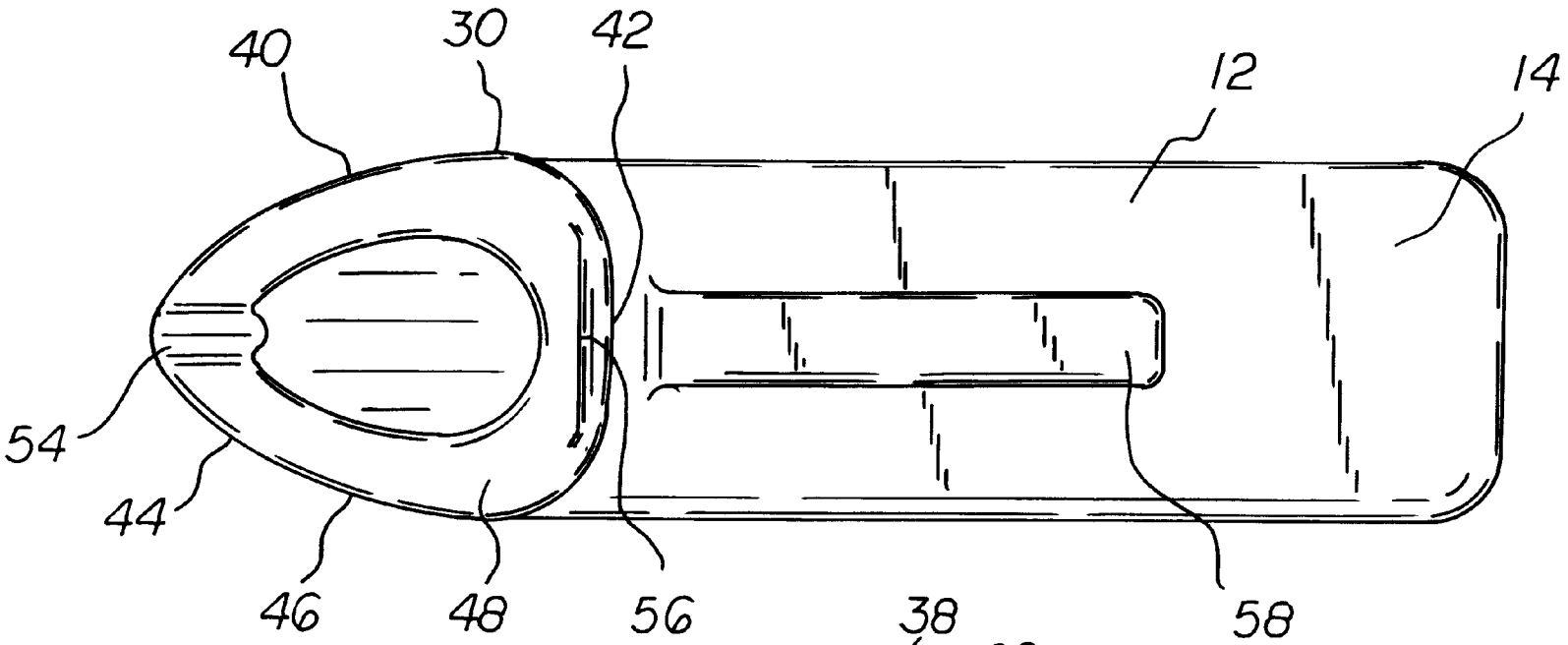
FIG. 2 is a top view showing the female saddle-like portion, the handle and the downward sloping mouth for urine collection.
Figure 3:
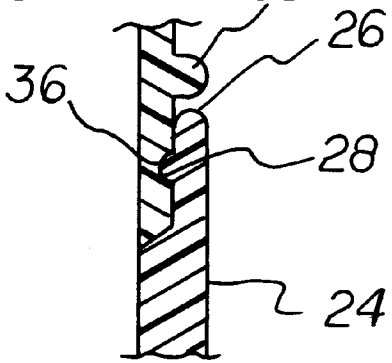
FIG. 3 is a cross-sectional view of present invention taken along line 3—3 shown in FIG. 1.

With reference now to the drawings, and in particular, to FIGS. 1 through 7 thereof, the preferred embodiment of the new and improved urinary receptacle embodying the principles and concepts of the present invention and generally designated by the reference number 10 will be described.

Specifically, it will be noted in the various Figures that the device relates to a urinary receptacle for comfortably adapting to a user's anatomy for receiving urine. In its broadest context, the device consists of a container, a neck portion, a female adaptor portion and a handle. Such components are individually configured and correlated with respect to each other so as to attain the desired objective.

The device 10 includes a container 12 having a generally rectangular configuration. The container has a planar top wall 14, a planar bottom wall 16, a pair of opposed long side walls 20, and a pair of opposed short side walls 21 together forming a liquid holding interior. The container is preferably fabricated of a molded plastic. The container could also be provided with measuring calibrations inscribed on the bottom wall.

The device includes a neck portion 24 comprising an aperture directed through the top wall of the container inwardly of one of the pair opposed short walls. The neck portion has a generally cylindrical configuration. The neck portion extends angularly upward from the container. The neck portion has an open upper end 26. The open upper end has an annular protrusion 28 disposed interiorly therearound. The open upper end acts as the receiving opening for when the device is used by a male. In the preferred embodiment, the neck portion has a length that is about ½ that of the container and is situated about an axis which forms an angle of about 120 degrees with an axis about which the container is formed.

The device includes a female adaptor portion 30 having a cylindrical lower portion 32 and an upper portion 34. The cylindrical lower portion has an annular recess 36 exteriorly thereof and a stop mechanism 38 disposed above the annular recess. The cylindrical lower portion is dimensioned for positioning within the open upper end of the neck portion whereby the annular protrusion snapidly engages the annular recess. The stop mechanism prevents the female adaptor portion from sliding entirely within the neck portion. As shown in FIG. 1, a lid 39 may be attached via a cord to the neck of the container for removably sealing the container.

Figure 6:
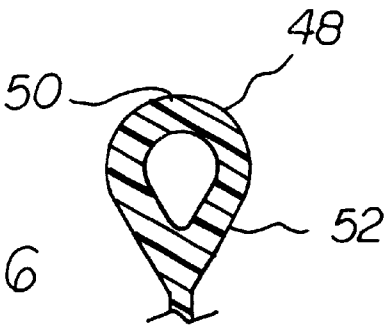
FIG. 6 is a cross section of side cushion of lateral saddle area showing soft cushion fit required to fit against soft tissue of the labia majora without occluding the opening into the urinal but obtaining a water-seal and allowing for all different sized women.

The upper portion includes an opening with a periphery 40 having a generally linear anterior extent 42 and a posterior extent 44 including a pair of tapering side portions 46. Preferably, the tapering side portions of the posterior extent of the periphery is lined with a cushioned area. As shown in FIG. 6, such cushioning is afforded by way of a hollow pad 48 formed of a soft rubber which is integrally coupled to the side portions of the posterior extent of the periphery. The pad has a closed loop cross-section along a length thereof which is defined by a horizontally oriented top portion 50 and a pair of converging tapered side portions 52. Ideally, the pad of the side portions resides entirely within a single horizontal plane which is offset and parallel with the top and bottom walls of the container.

Figure 5:
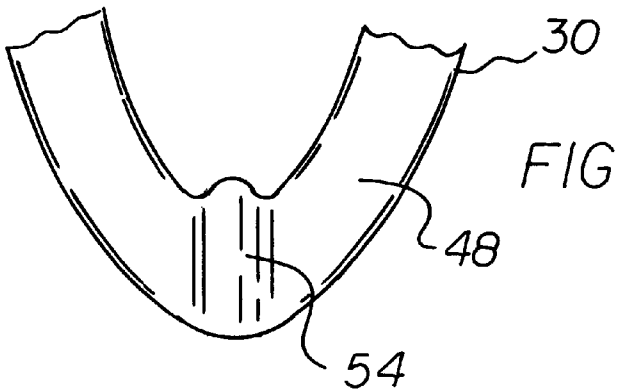
FIG. 5 is a top view of posterior septal seal showing angular slope for fit into the septal area between the vagina and the rectum by exerting pressure inwardly on the handle.
Figure 7:
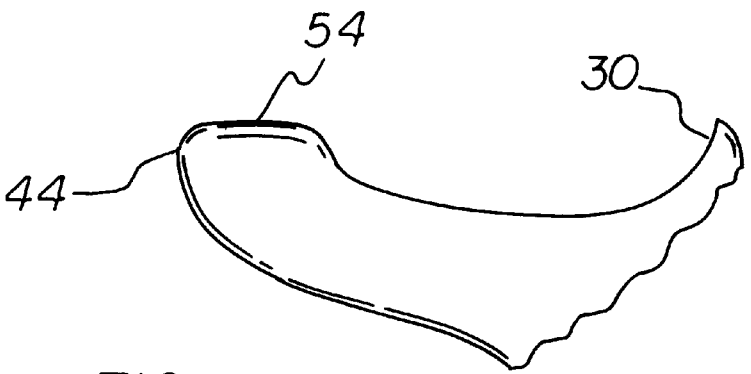
FIG. 7 is a side view of septal bulbous portion showing firm, angular, specific shape for fitting against septal area when pressure is applied inward toward the posterior perineum.
Figure 4:
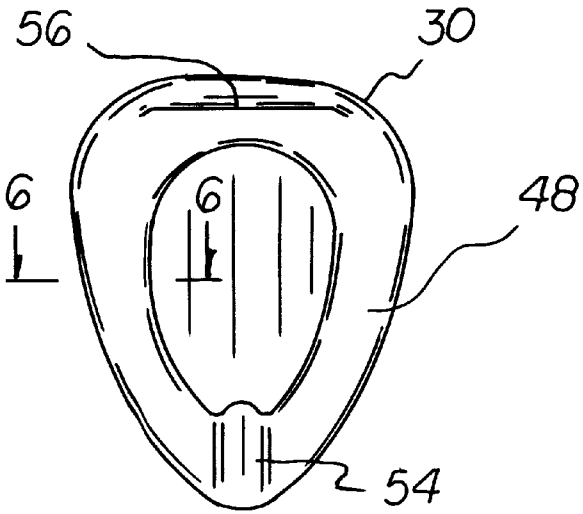
FIG. 4 is a saddle-like portion for female part showing top view of posterior bulbous seal, and the mouth for directional flow of urine to be downward regardless of position.

With reference now to FIGS. 4, 5 & 7, the upper portion preferably includes an elongated rigid posterior protrusion 54 integrally formed on the periphery of the female adapter portion between the ends of the pad and situated along an axis which remains in parallel with a longitudinal axis of the container. Further, the elongated posterior protrusion has a length which is greater than a width of the pad.

The upper portion of the female adapter further includes an anterior dam 56 which extends along an entire length of the linear anterior extent of the periphery of the upper portion. The anterior dam preferably has a height equal to that of the elongated protrusion.

A handle portion 58 is formed integrally with the neck portion. The handle portion extends from the neck portion in an essentially parallel relationship with the top wall of the container. A lower surface of the handle portion has grips 59 formed therein.

The device provides an effective urinal that is to be used by both males and females that is leak-proof and convenient. The device is a self-contained, one-piece construction urine collection apparatus for use by males and females which adapts to specific anatomies. The device conforms to the female perineal anatomy to collect urine in a liquid-tight seal to the lateral vulva, anteriorly to the symphysis pubic area and the posterior sepal area to provide comfort and convenience such as when men use in a urinal.

During use, an adaptive contour fit is afforded with firmness in posterior section to press into septal area soft tissue for a water-seal protection to the buttocks when a female is in a lying position. Further, the saddle-like lateral lip sections in softer cushioned plastic afford a water-sealed fit against the labia in much the same way an anesthesiologists mask fits the contours of the face to enclose air without leaks. Positioning against the labia assures the user that the urethra is centered over the opening. The anterior dam area is positioned against the symphysis pubis area when the user pulls inward on the handle to assure a splash-proof void, and also assures the user the apparatus is in the right position. The handle is designed to provide positioning and by pushing inward, a complete seal to the perineum posteriorly, laterally, and anteriorly. The handle is located in such a manner that is in the right position for even an obese woman to effect correct positioning and be able to remove after use without spilling. The volume capacity is approximately the same as conventional urinals now available which is between 600 to 800 cc. The calibration markings are adapted for allowing accurate output measurements. The flow of fluid is downward with the flow of gravity without spill in lying, sitting and standing position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A urinary receptacle for comfortably adapting to a user's anatomy for receiving urine comprising, in combination:

a container having a generally rectangular configuration, the container having a top wall, a bottom wall, a pair of opposed long side walls, a pair of opposed short side walls together forming a liquid holding interior,;

a neck portion comprising an aperture directed through the top wall of the container inwardly of one of the pair opposed short walls, the neck portion having a generally cylindrical configuration, the neck portion extending angularly upward from the container, the neck portion having an open upper end, the open upper end having an annular protrusion disposed interiorly therearound, the open upper end being a receiving end for the male anatomy;

a female adaptor portion being formed of a contoured plastic molded shaped with varying thicknesses of plastic, the female adaptor portion having a cylindrical lower portion and an upper portion, the upper portion including a periphery having a generally linear anterior extent and a posterior extent including a pair of tapering side portions, the tapering side portions of the posterior extent of the periphery being lined with a hollow pad formed of a soft rubber which is integrally coupled to the side portions of the posterior extent of the periphery, the pad having a closed loop cross-section along a length thereof which is defined by a horizontally oriented top portion and a pair of converging tapered side portions, the upper portion further including an elongated posterior protrusion positioned between ends of the pad and situated along an axis which remains in parallel with a longitudinal axis of the container, the elongated posterior protrusion having a length which is greater than a width of the pad, the upper portion of the female adapter further including an anterior dam which extends along an entire length of the linear anterior extent of the periphery of the upper portion, the anterior dam preferably having a height equal to that of the elongated protrusion; and a handle portion formed integrally with the neck portion, the handle portion extending from the neck portion in an essentially parallel relationship with the top wall of the container, a lower surface of the handle portion having grips formed therein.

* * * * *